US012168588B2

(12) United States Patent
Dumoulin et al.

(10) Patent No.: US 12,168,588 B2
(45) Date of Patent: Dec. 17, 2024

(54) THREAD GUIDE ELEMENT AND YARN CLEARER FOR A WORKSTATION OF A TEXTILE MACHINE WITH A THREAD GUIDE ELEMENT

(71) Applicant: Saurer Intelligent Technology AG, Arbon (CH)

(72) Inventors: Charles Leopold Elisabeth Dumoulin, Balgach (CH); Kalidass Santhoshkumar, Coimbatore (IN); Ilir Adili, Widnau (CH)

(73) Assignee: Saurer Intelligent Technology AG, Arbon (CH)

( * ) Notice: Subject to any disclaimer, the term of this patent is extended or adjusted under 35 U.S.C. 154(b) by 84 days.

(21) Appl. No.: 17/981,187

(22) Filed: Nov. 4, 2022

(65) Prior Publication Data

US 2023/0137833 A1 May 4, 2023

(30) Foreign Application Priority Data

Nov. 4, 2021 (EP) ..... 21206581

(51) Int. Cl.
*B65H 57/04* (2006.01)
*D02J 3/00* (2006.01)

(52) U.S. Cl.
CPC ..... *B65H 57/04* (2013.01); *D02J 3/00* (2013.01); *B65H 2601/21* (2013.01); *B65H 2701/31* (2013.01)

(58) Field of Classification Search
CPC .... B65H 57/04; B65H 2701/31; B65H 57/02; B65H 57/06; B65H 57/10; B65H 57/22; B65H 63/061; B65H 2601/21; B65H 63/062; B65H 54/702; B65H 54/71; B65H 2701/174; B65H 2406/10; D03J 3/00; D03J 1/14; D02J 3/12; D02J 3/14; D02J 7/00; D02J 3/02
USPC ..... 242/157 R; 28/222, 224, 226, 227, 232, 28/173, 212, 233–238
See application file for complete search history.

(56) References Cited

U.S. PATENT DOCUMENTS

| | | | | | |
|---|---|---|---|---|---|
| 215,990 | A * | 5/1879 | Sullivan | B65H 57/04 | 242/157 R |
| 278,487 | A * | 5/1883 | Atherton | B65H 57/04 | 242/157 R |
| 748,300 | A * | 12/1903 | Mckean | B65H 57/04 | 242/157 R |
| 1,422,106 | A * | 7/1922 | Klots | B65H 63/061 | 28/232 |
| 1,457,208 | A * | 5/1923 | Cass | B65H 57/04 | 242/157 R |
| 1,659,956 | A * | 2/1928 | Matthews | B65H 63/061 | 28/235 |
| 1,870,152 | A * | 8/1932 | Taylor | B65H 63/061 | 28/236 |

(Continued)

FOREIGN PATENT DOCUMENTS

| | | | |
|---|---|---|---|
| EP | 3604635 | A1 | 2/2020 |
| WO | 2013131198 | A1 | 9/2013 |
| WO | 2019076431 | A1 | 4/2019 |

*Primary Examiner* — Amy Vanatta
(74) *Attorney, Agent, or Firm* — Fox Rothschild LLP

(57) ABSTRACT

The present invention relates to a thread guide element for a yarn monitoring and/or yarn processing unit as well as to a yarn clearer for a workstation of a textile machine with at least one thread guide element.

13 Claims, 2 Drawing Sheets

(56) References Cited

U.S. PATENT DOCUMENTS

Figure 1:
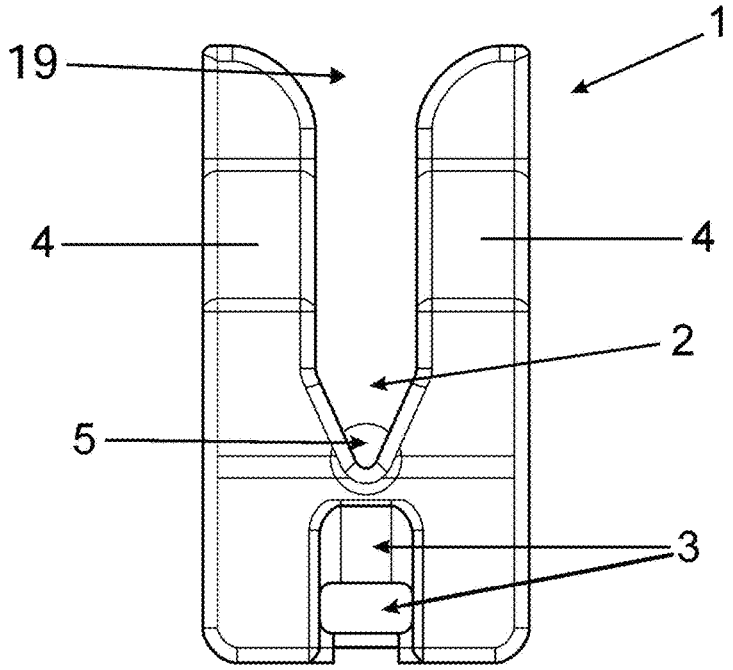

| | | | | | |
|---|---|---|---|---|---|
| 1,912,256 | A * | 5/1933 | Coradi | B65H 57/04 242/157 R |
| 2,131,859 | A * | 10/1938 | Schmadeke | B65H 63/061 28/232 |
| 2,232,441 | A * | 2/1941 | Duraffourg | B65H 63/061 28/235 |
| 3,502,282 | A * | 3/1970 | Felix | B65H 57/006 242/157 R |
| 11,130,651 | B2 | 9/2021 | Brunner | |
| 2014/0373620 | A1 | 12/2014 | Parameswaran et al. | |
| 2020/0002120 | A1* | 1/2020 | Peuker | D01H 13/02 |
| 2021/0198079 | A1* | 7/2021 | Brunner | D02G 1/04 |

* cited by examiner

THREAD GUIDE ELEMENT AND YARN CLEARER FOR A WORKSTATION OF A TEXTILE MACHINE WITH A THREAD GUIDE ELEMENT

This application claims priority to European Patent Application No. 21206581.7 filed on Nov. 4, 2021. The content of the application is incorporated herein by reference in its entirety.

The present invention relates to a thread guide element for a yarn monitoring and/or yarn processing unit as well as to a yarn clearer for a workstation of a textile machine with at least one thread guide element.

A thread is typically wound at very high thread running speeds, resulting in an undesirable high material abrasion in the area of the textile machine surfaces adjacent to and/or in contact with the thread. This relates, for example, to a thread guide channel of a yarn monitoring and/or yarn processing unit, in particular of a yarn clearer, on a textile machine producing take-up packages.

Due to the high speed of movement as well as due to the structure and the fibre ends protruding from the thread surface, the thread generates a suction and thus an associated air flow along the movement direction of the thread, which is subject to Bernoulli's law. Accordingly, even small variations in the distance from surfaces to the moving thread and, in particular, variations in the width of a thread guide channel lead to pressure differentials and, as a result, to undesirable turbulence that results in increased material abrasion over time. This effect is particularly pronounced in the area of an inlet and/or an outlet of a thread guide channel.

In addition, the narrower the thread guide channel, the stronger this effect, which means that a particularly wide thread guide channel would be preferable. However, for numerous applications, for example for monitoring of at least one thread parameter and/or for an efficient processing of the thread, a particularly narrow thread guide channel is preferred, so that in order to ensure an effective function of a yarn monitoring and/or yarn processing unit, in particular a yarn clearer, a narrow thread guide channel is necessary; thus, increased material abrasion as a result of undesired turbulence formation cannot be avoided in devices of the prior art.

Furthermore, such turbulence that occurs not only leads to material abrasion at the yarn monitoring and/or yarn processing unit, but also to a deterioration in the quality of the thread itself, on the surface of which the turbulence can act directly and thereby pull further fibre ends out of the thread. In addition, due to the turbulence, forces act radially on the rapidly moving thread, causing the thread path to change, something which on the one hand makes thread monitoring much more difficult and on the other hand can result in the thread contacting a surface of the yarn monitoring and/or yarn processing unit, in particular the yarn clearer, which again can lead to a deterioration in quality or even damage to the thread.

These negative effects are particularly great in the area of thread guide elements, which are typically arranged at the inlet and/or outlet of a thread guide channel of a yarn monitoring and/or yarn processing unit, in particular a yarn clearer.

The problem addressed by the present invention is therefore one of providing a thread guide element which significantly reduces the material abrasion at a yarn monitoring and/or yarn processing unit, in particular of a yarn clearer, avoids a deterioration of the quality of the thread or the yarn in the area of the thread guide element and thereby enables an improvement of the yarn monitoring and/or yarn processing as well as an increase in the yarn speed during winding.

The problem is solved according to the present invention by a thread guide element for a yarn monitoring and/or yarn processing unit, in particular for a yarn clearer, according to claim 1, as well as by a yarn clearer for a workstation of a textile machine according to claim 10. Advantageous further developments are stated in the dependent claims.

The thread guide element according to the present invention for a yarn monitoring and/or yarn processing unit, in particular for a yarn clearer, has a thread guide opening for guiding a thread sideways or orthogonally to a thread path, a thread pick-up opening for introducing the thread into the thread guide opening, and an air flow equalisation opening for equalising the static pressure on both sides of the thread guide element and, in particular, within a thread guide channel, and/or for generating a laminar air flow at least on one side of the thread guide element, at least in the region of the guided thread.

In addition, the present invention also relates to a yarn clearer for a workstation of a textile machine with a thread guide channel with a thread inlet for feeding the thread and a thread outlet for discharging the thread, as well as with at least one thread guide element and, preferably, at least one thread guide element according to the present invention.

The inventors have recognised that by means of an air flow equalisation opening for equalising the static pressure on both sides of the thread guide element and/or for generating a laminar air flow at least on one side of the thread guide element, at least in the area of the thread, a significant reduction of the material abrasion of a yarn monitoring and/or yarn processing unit, in particular of a yarn clearer, and at the same time a significant increase in the yarn quality, can be achieved in a simple manner. In addition, the thread follows a particularly constant thread path, enabling a significant improvement in yarn monitoring and/or yarn processing as well as increased yarn speed.

A thread guide element, also referred to as an "eyelet", is understood to be a component or structural unit which guides a thread, in particular a thread moving rapidly along its central longitudinal axis, in at least one spatial direction, i.e. it limits the position of the thread in at least one direction and preferably keeps it constant. Preferably, the thread is guided, in particular by means of the thread guide opening, at least on two sides and especially preferably at least on three sides and very particularly preferably exactly on three sides, in particular radially to the thread running direction or orthogonally to the thread path. Furthermore, the thread is preferably guided in direct contact with a part, in particular by means of a smooth surface, of the thread guide element, and particularly preferably a thread guide opening.

Although a thread guide element can in principle be arranged on any device for transporting a thread, the thread guide element according to the present invention is provided for a yarn monitoring and/or yarn processing unit, in particular a yarn clearer, for example in order to be able to detect the presence and/or absence of a thread. In addition, the yarn monitoring and/or yarn processing unit, in particular the yarn clearer, can preferably detect at least one yarn parameter and/or is preferably configured to detect a yarn defect.

According to the present invention, the thread is guided through the thread guide element by means of a thread guide opening, which in principle can be configured as desired, for example as an opening, a channel open on one side, a gap, a slot or the like. The thread guide opening can surround the thread on several sides or only over part of its circumference. Preferably, the thread guide opening has an open shape so that the thread can be introduced laterally without severing the thread and/or with a central area into the thread guide opening via the thread pick-up opening. Preferably, the thread guide opening is arranged in the thread guide element. Particularly preferably, the thread guide opening is a narrow passage or gap, in which the width of the thread guide opening is preferably less than 5 mm, more preferably less than 3 mm, and very particularly preferably less than 2 mm.

The thread path is the path of the moving thread and preferably runs essentially unchanged in the thread running direction and/or along a constant path and/or is specified by the thread guide element and in particular by the thread guide opening. Particularly preferably, the thread path, especially between two thread guide elements of a yarn clearer, is linear. Very particularly preferably, the thread path between the thread inlet and the thread outlet of a yarn clearer runs along a straight line.

In principle, the yarn clearer can be formed in any way and be provided for monitoring the thread passing by and/or its parameters and/or for processing the thread, in particular for cutting out defective sections. Accordingly, the yarn clearer preferably has at least one unit for monitoring and/or processing the thread between the thread inlet and the thread outlet, and in particular in the thread guide channel. In particular, the yarn clearer can have a cutting device to clear out detected yarn defects and/or yarn faults, i.e. to cut off a defective section. The yarn clearer is preferably formed for arrangement on a textile machine, particularly preferably on a textile machine producing take-up packages and/or a textile machine provided for rewinding.

An air flow equalisation opening is understood to be at least or exactly one opening, at least or exactly one passage, or at least or exactly one channel, which allows pressure equalisation of two areas arranged on both sides of the air flow equalisation opening and/or a gas flow or a volumetric flow between these areas. In this case, the air flow equalisation opening can be formed by a single component or by the surfaces or sections of several components. Preferably, the air flow equalisation opening is arranged entirely within a component and/or is formed entirely by a component, the component particularly preferably also exhibiting the thread guide opening. Very particularly preferably, the air flow equalisation opening is arranged adjacent to the thread guide opening.

According to the present invention, one of the functions of the air flow equalisation opening can be to create a laminar air flow on one side of the thread guide element, in particular inside the yarn monitoring and/or yarn processing unit. Generating a laminar air flow is initially understood to be merely a reduction of a turbulent air flow, but the generated air flow is preferably predominantly laminar. However, the laminar air flow is still allowed to have a small turbulent component, in which case the turbulent component is particularly preferably as small as technically possible. Preferably, the turbulent component is less than 50%, more preferably less than 30%, very particularly preferably less than 20%, and especially preferably less than 10%. The side of the thread guide element at which the laminar air flow is generated is preferably arranged behind the thread guide element in the case of a thread guide element arranged at a thread inlet of a yarn monitoring and/or yarn processing unit and/or preferably in front of the thread guide element in the case of a thread guide element arranged at a thread outlet. In general, the laminar air flow is preferably generated in a measuring channel which delimits a sensor range of the yarn monitoring and/or yarn processing unit, and in particular preferably within the thread guide channel. The air flow can basically be any gas stream, which can be formed from ambient air or may have a different gas composition.

The thread guide channel can surround the thread inside the yarn clearer in sections, on several sides or completely on all sides, or it can surround the thread only around part of its circumference and otherwise be open. Preferably, the thread guide channel is open on at least one side, and particularly preferably on exactly one side along the path of the thread, for example to allow easy insertion of the thread.

A preferred embodiment of the thread guide element provides for the thread guide opening to be formed in a forked shape with two thread guide sections between which the thread is guided and/or which converge in a preferably U-, C- or V-shaped thread guide area. Preferably, the thread guide sections run parallel to one another at least in sections and/or are at a constant distance from one another. Furthermore, the two thread guide sections are preferably formed mirror-symmetrically to one another and/or arranged mirror-symmetrically to one another on the thread guide element. Preferably, the thread path runs exclusively in the thread guide area and thereby particularly preferably in that part of the U-, C- or V-shaped area in which the thread is guided primarily for at least 90°, particularly preferably for at least 135° and very particularly preferably for 180° of its circumference.

In an advantageous embodiment of the thread guide element, the air flow equalisation opening completely penetrates the thread guide element in the thread running direction and/or is arranged at a distance from the thread guide opening and/or adjacent thereto, in which case a particularly efficient pressure equalisation and/or a laminar air flow can be generated particularly easily in the area of the thread path. Preferably, the thread guide opening and the air flow equalisation opening extend at least in the region of one side of the thread guide element and, particularly preferably, completely separately from one another. In particular, the air flow equalisation opening is preferably formed and/or arranged such that the thread cannot enter the air flow equalisation opening. In particular, an embodiment of the thread guide element is preferred in which the air flow equalisation opening is arranged on a side of the thread guide opening facing away from the thread pick-up opening, preferably in a front view of the thread guide element below the U- or V-shaped thread guide area in which the two thread guide sections converge, and/or centrally with respect to the thread guide opening.

The air flow equalisation opening, in particular the air flow equalisation opening directed towards the outside of the yarn monitoring and/or yarn processing unit, can basically be of any configuration and have any shape. However, a preferred embodiment of the thread guide element is one in which the air flow equalisation opening is formed in a round or elliptical shape on an inlet side into the yarn monitoring and/or yarn processing unit, in particular with an opening that is the largest size permitted by the design. Alternatively or additionally, the air flow equalisation opening on an outlet side of the thread from the yarn monitoring and/or yarn processing unit can also be formed in a round or elliptical shape in a manner as described above. The preferred round or elliptical embodiment allows for a reduction in flow resistance.

In order to be able to control the characteristics of the air flow on the thread outlet side of the thread guide element and in particular in the thread guide channel of a yarn monitoring and/or yarn processing unit, it is preferred that the thread guide element extends over a longer section along the thread path than would be necessary for straightforward thread guidance. In this case, the length of the thread guide opening in the thread running direction or along the thread path in an advantageous further development of the thread guide element is at least between 0.75 mm and 5 mm, preferably at least between 1 mm and 3 mm and particularly preferably at least between 1 mm and 2 mm. Alternatively or additionally, the length of the thread guide opening in the thread running direction or along the thread path is longer than the width of the thread guide opening by at least a factor of 1.5, preferably at least 2.0, particularly preferably at least 2.5, and very particularly preferably at least 3.0. The width of the thread guide opening is understood to be the distance between the two thread guide sections, in particular in an area of a mutually parallel arrangement and/or in the area guiding the thread. The length of the thread guide opening is correspondingly the extension along the thread path or parallel to the thread path.

In particular, a preferred embodiment is a thread guide element configured in two successive sections in a direction of the thread path, with a first section for thread guidance and a second section for changing the air flow being formed in a particularly preferred manner. Accordingly, the thread guide element preferably has a thread guide section extending along the thread running direction or along the thread path, as well as a flow-calming section adjacent thereto, in which case particularly preferably no further thread guidance takes place in the flow-calming section. Accordingly, the thread in the flow-calming section preferably does not make contact with the thread guide sections and, particularly preferably, the thread in the flow-calming section does not make contact with any surface of the thread guide element. In principle, the flow-calming surface can separate the air flow equalisation opening from an area of the thread in the thread guide element, or alternatively, the thread can be guided through an area at least partially surrounded by one or more flow-calming surfaces.

In order to generate a laminar air flow particularly effectively, a preferred embodiment of the thread guide element provides for the air flow equalisation opening to be formed on a side of the thread guide section facing away from the thread pick-up opening and, at least in the extension region of the thread guide section along the thread running direction, preferably the entire air flow equalisation opening, has a flow-calming surface optimised by computational fluid dynamics (CDF) calculations, in order to generate a laminar air flow in the flow-calming section and/or in an area adjacent to or delimiting it. In particular, a surface of the thread guide opening without edges and/or without angles greater than or equal to 90° is preferred.

Accordingly, a likewise preferred further development of the thread guide element provides for the air flow equalisation opening in the region of the thread guide section and preferably extending over the entire thread guide section to have a surface that is angled relative to the thread running direction by an angle of between 25° and 60°, preferably between 35° and 55°, particularly preferably between 40° and 50°, and very particularly preferably by 45°. In this case, the angulation serves to form an angled ventilation channel by means of which static equalisation can be established close to a base of an adjacent sensor range of a sensor. In this way, a pressure gradient within the sensor range, which is preferably limited by a measuring channel assigned to the sensor, can be kept as small as possible.

According to a preferred embodiment, the air flow equalisation opening has an air flow outlet plane the normal vector of which points in a direction away from the thread pick-up opening while confining an angle greater than or equal to 0° with the thread path. As a result, the laminar flow to be generated in the area of the sensor base can be ensured in an improved manner.

Further preferably, according to one embodiment, the thread guide element is provided with a positioning aid for positioning the thread guide element on a yarn monitoring or yarn processing unit on a side of the thread guide element facing away from the thread pick-up opening and/or the air flow equalisation opening. The thread guide element can thus be positioned more easily and precisely, in particular at the inlet and/or outlet of the sensor range of the yarn monitoring or yarn processing unit. For example, the positioning aid can be configured as a recess for receiving a correspondingly designed protrusion, for example a flange, which enables exact placement at an inlet or outlet of a thread guide channel of the yarn monitoring or yarn processing unit. Preferably, the positioning aid can be designed to attach the thread guide element to the inlet or outlet of the thread guide channel by means of clamping, latching or screwing.

In an advantageous further development of the yarn clearer for a workstation of a textile machine, a thread guide element according to the present invention is arranged at an inlet and at an outlet of the thread guide channel, respectively. Preferably, both or all thread guide elements of the yarn clearer are formed identically and/or mirror-symmetrically to one another. If the thread guide elements are identical to one another, it is preferred that the two thread guide elements are each arranged on the yarn clearer with identical sides facing one another.

Figure 2:
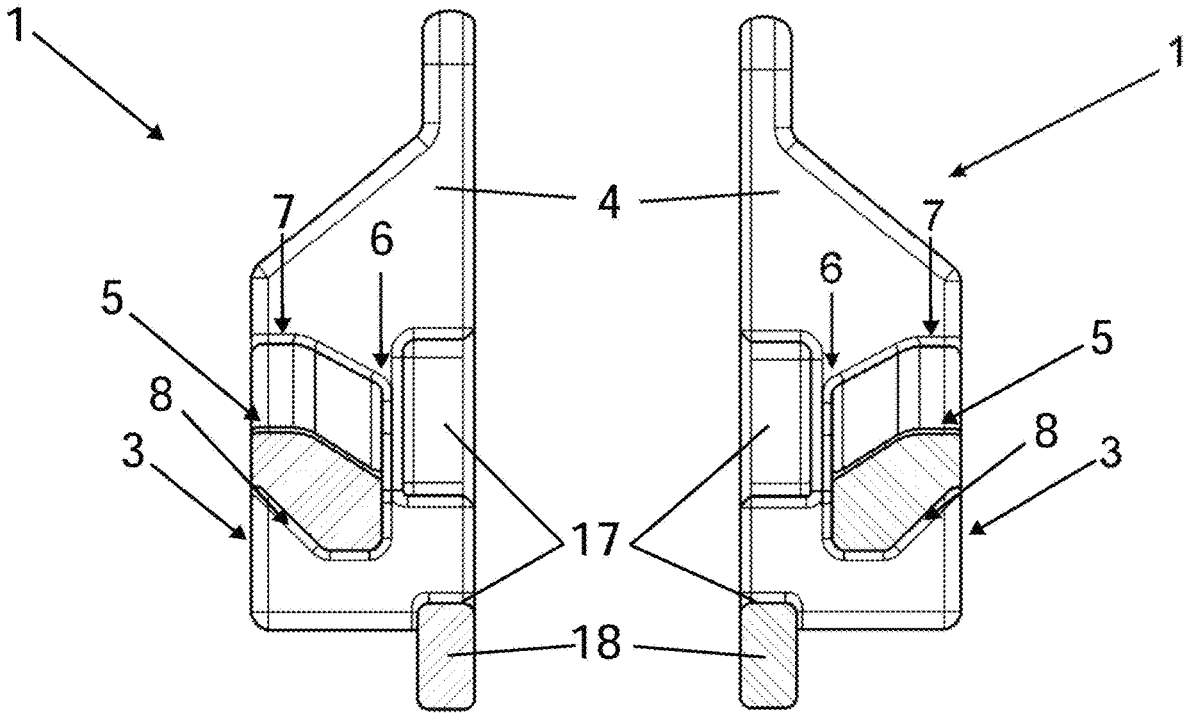
Figure 3:
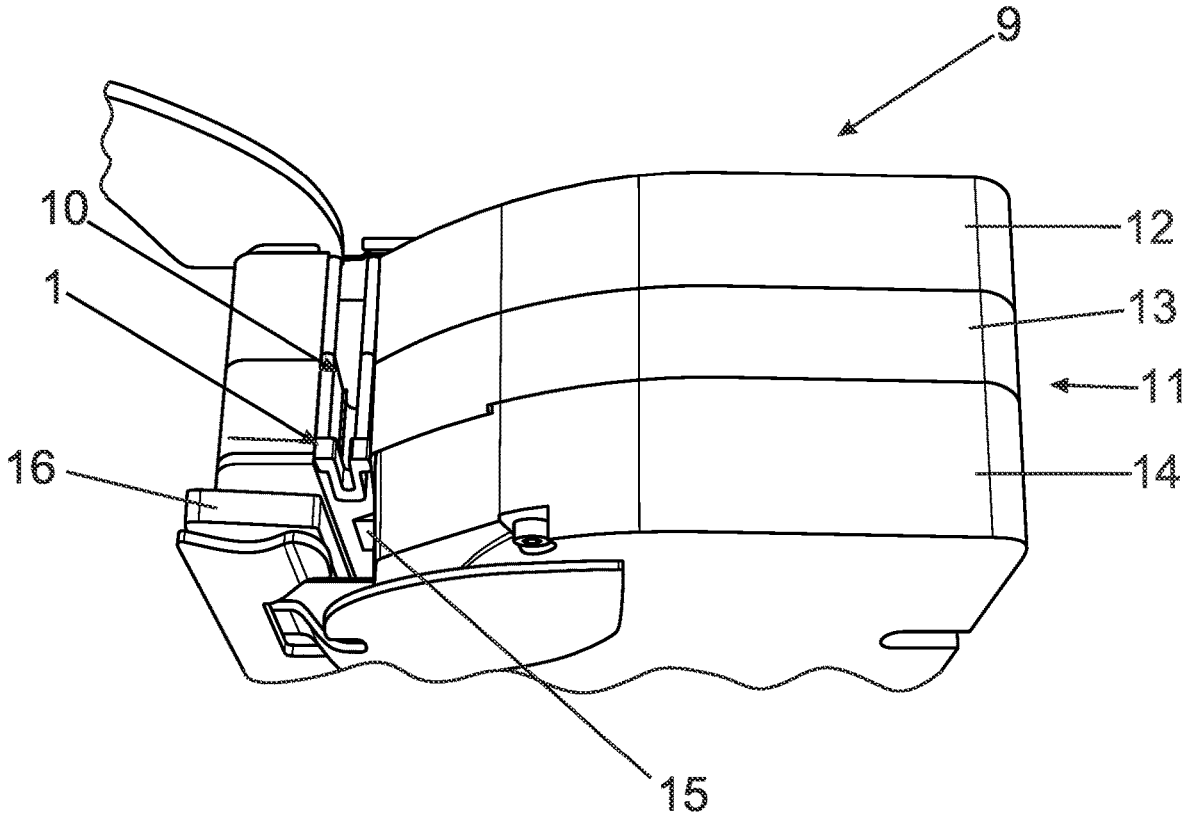

An embodiment of a thread guide element according to the present invention is described in more detail below with reference to the drawings. In the drawings:

FIG. 1: shows a schematic front view of a thread guide element with the inlet side for a thread;

FIG. 2: shows a schematic sectional view of two of a thread guide element shown in FIG. 1, and FIG. 3 shows a perspective schematic view of a yarn clearer.

A thread guide element 1 for a yarn clearer 9 of a workstation of a textile machine, shown schematically in FIG. 1, is formed in one piece and has two thread guide sections 4 arranged in a forked shape with one another, which converge in a V-shape in a thread guide area 5 from the direction of a thread pick-up opening 19. In this case, the two thread guide sections 4 form a gap that is used as a thread guide opening 2 that is open on one side. In the thread guide area 5 of the thread guide opening 2, a thread can be guided at high speed and protected against lateral deviations of the thread path.

The thread guide opening 2 has smooth surfaces aligned in the thread running direction so that the thread can be guided at high speed with as little adhesion as possible. However, the fibres protruding from the surface of the thread moving rapidly in the direction of the thread path create suction, which results in an air flow in and behind the thread guide element 1 and a pressure differential in front of and behind the thread guide element 1.

To equalise this static pressure differential, the thread guide element 1 has an air flow equalisation opening 3 with an elliptical opening below the thread guide opening 2, in which case the air flow equalisation opening 3 completely penetrates the thread guide element 1 in the direction of the thread path.

In this context, FIG. 2 shows two thread guide elements 1 in a schematic sectional view, one thread guide element 1 being arranged on the inlet side and the other thread guide element 1 being arranged on the outlet side of a sensor range of a yarn clearer 9, which is not shown running between the two thread guide elements 1.

In order to avoid a turbulent air flow on the thread outlet side of the thread guide element 1 and to generate a laminar air flow instead, the respective thread guide element 1 has a flow-calming section 6 adjacent to a thread guide section 7 along the thread path and directly adjoining it. In this case, the thread guide element 1 is integrally formed with the thread guide section 7 and the flow-calming section 6.

In this case, the flow-calming section 6 has at least one flow-calming surface 8 that has been optimised by computational fluid dynamics calculations to produce a particularly laminar air flow in and behind the thread guide element 1. In this case, the thread guide element 1 has a flow-calming surface 8 in the thread guide section 7, which runs towards the thread or the thread path at an angle of about 45° and leads to a deflection of the resulting air flow.

FIG. 3 shows a schematic perspective view of an embodiment of a yarn clearer 9 with a thread guide element 1 as described above. The thread guide element 1 is arranged along a thread path on the inlet side to a sensor range 10 of the yarn clearer 9. Alternatively or additionally, according to a further embodiment, such a thread guide element 1 may be arranged along the thread path on the outlet side of the sensor range 10.

The yarn clearer 9 according to the illustrated embodiment has a housing body 11 formed in three parts with a first and a second housing part 12, 13 each for accommodating a sensor system monitoring the thread crossing the sensor range 10 bounded on the inlet side by the thread guide element 1. For example, one of the first and second housing parts 12, 13 can include a capacitive sensor system and the other housing part can include an optical sensor system for monitoring different thread parameters. The third housing part 14 of the housing body 11 is arranged along the thread path adjacent to the second housing part 13, the third housing part 14 partially enclosing a cutting device with a cutting knife 15 crossing the thread path of the yarn clearer 9 and having a stop 16 for the cutting knife 15 for severing a thread (not shown) running in between.

LIST OF REFERENCE NUMBERS

1 Thread guide element
2 Thread guide opening
3 Air flow equalisation opening
4 Thread guide section
5 V-shaped thread guide area
6 Flow-calming section
7 Thread guide section
8 Flow-calming surface
9 Yarn clearer
10 Sensor range
11 Housing body
12 First housing part
13 Second housing part
14 Third housing part
15 Cutting knife
16 Stop
17 Recess/positioning aid
18 Flange
19 Thread pick-up opening

The invention claimed is:

1. A thread guide element (1) for a yarn monitoring and/or yarn processing unit, comprising:
- a thread guide opening (2) configured to guide a thread laterally to a thread path,
- a thread pick-up opening (19) configured to enable the thread to be inserted into the thread guide opening (2), an air flow equalisation opening (3) configured to:
- equalize static pressure on both sides of the thread guide element (1); and/or
- generate a laminar air flow on one side of the thread guide element (1) at least in the area of the guided thread;
- wherein the air flow equalisation opening (3) is round or elliptical in its opening plane and in its outlet plane.

2. The thread guide element (1) according to claim 1, wherein the thread guide opening (2) is formed in a forked shape with two thread guide sections (4) between which the thread is guided and/or between which the two thread guide sections (4) converge in a U- or V-shaped thread guide area (5).

3. The thread guide element (1) according to claim 1, wherein the air flow equalisation opening (3):
- is configured to completely penetrate the thread guide element (1) in a thread running direction; and/or
- is arranged such that it is spaced apart from and/or adjacent to the thread guide opening (2).

4. The thread guide element (1) according to claim 1, wherein the air flow equalisation opening (3) is arranged on a side of the thread guide opening (2) facing away from the thread pick-up opening (19), centrally with respect to the thread guide opening (2).

5. The thread guide element (1) according to claim 1, wherein a length of the thread guide opening (2) along the thread path:
- is between 1 mm and 3 mm; and/or
- is longer than a width of the thread guide opening (2) by at least a factor of 2.0.

6. The thread guide element (1) according to claim 1, further comprising:
- a thread guide section (7) extending along a thread running direction; and
- a flow-calming section (6), in which no thread guidance takes place, extending along the thread running direction and adjacent to the thread guide section (7).

7. The thread guide element (1) according to claim 6, wherein the air flow equalisation opening (3):
- is formed on a side of the thread guide section (7) facing away from the thread pick-up opening (19), and
- comprises, at least in an extension region of the thread guide section (7) along the thread running direction, a flow-calming surface (8) optimised by computational fluid mechanics calculations, configured to generate a laminar air flow in the flow-calming section (6) and/or in a region adjacent thereto.

8. The thread guide element (1) according to claim 6, wherein the air flow equalisation opening (3) comprises a flow-calming surface (8) extending over the thread guide section (7) and positioned at an angle between 40° and 50° with respect to the thread running direction.

9. The thread guide element (1) according to claim 1, wherein the air flow equalisation opening (3) has an air flow outlet plane, the normal vector of which points in a direction away from the thread pick-up opening (19) confining an angle with the thread path.

10. The thread guide element (1) according to claim 1, further comprises a positioning aid (17), configured to position the thread guide element (1) on a yarn monitoring or yarn processing unit, wherein the positioning aid (17) is provided on a side of the thread guide element (1) facing away from the thread pick-up opening (19) and/or the air flow equalisation opening (3).

11. A yarn clearer (9) for a workstation of a textile machine, comprising:

a thread guide channel comprising:

a thread inlet configured to enable the thread to be fed; and a thread outlet configured to discharge the thread; and at least one thread guide element (1) according to claim 1.

12. The yarn clearer (9) for a workstation of a textile machine according to claim 11, further comprising a thread guide element (1) arranged at an inlet and/or at an outlet of the thread guide channel.

13. The yarn clearer (9) for a workstation according to claim 11, wherein:

the thread guide channel is configured to delimit at least one sensor range (10) of a sensor, surrounded by the yarn clearer (9), configured to detect defined parameters of the thread running through the thread guide channel, and a normal vector of an air flow outlet plane of the air flow equalisation opening (3) points in a direction of an edge area of the sensor range (10) opposite the thread pick-up opening (19).

* * * * *